United States Patent [19]

Fischer

[11] 3,955,452

[45] May 11, 1976

[54] CUTTING DEVICE PARTICULARLY FOR PLASTIC MATERIALS

[76] Inventor: Artur Fischer, Altheimer Strasse 219, D-7241 Tumlingen, Germany

[22] Filed: Apr. 1, 1974

[21] Appl. No.: 456,991

[30] Foreign Application Priority Data

Mar. 31, 1973 Germany ..... 7312222[U]

[52] U.S. Cl. ..... 83/171; 83/651.1

[51] Int. Cl.[2] ..... B26F 3/12

[58] Field of Search ..... 83/171, 651.1

[56] References Cited

UNITED STATES PATENTS 2,987,598 6/1961 Chace et al. ..... 83/171

3,018,355 1/1962 Wallerstein ..... 83/171

*Primary Examiner*—Donald R. Schran

*Attorney, Agent, or Firm*—Michael J. Striker

[57] ABSTRACT

In combination with an electrically heated wire for cutting plastic material, a guide plate is provided for supporting the material to be cut. The plate is mounted movable between a first and a second position and circuit means are provided for energizing the wire and including a normally open switch arranged to be closed by said plate in said second position of the latter.

9 Claims, 3 Drawing Figures

CUTTING DEVICE PARTICULARLY FOR PLASTIC MATERIALS

BACKGROUND OF THE INVENTION

The invention relates to a cutting device of the type wherein an electrically heated wire extends across a frame for the cutting of plastic materials, particularly plastic foam materials such as porous styrene compounds, and wherein the plastic material to be cut is supported by a plate attached to the frame. The cutting wire is made for example from constantan and is typically dimensioned so that, when the circuit for the wire is closed, the current heats the wire to a temperature ranging from 200° to 300°C thereby enabling the wire to cut said plastic foam material. It has been usual to provide a normally open push-button switch which is manually depressed and must be manually held in depressed position in order to energize the cutting wire; and to deenergize the cutting wire by manual release of the push-button. This arrangement has made it possible to economize the use of electric power incident to the cutting operation. Such arrangement has been fairly successful when the plastic material was stationary and the cutting device, including the push-button switch thereon, was moved manually for the cutting operation. However, difficulty has been encountered in the many, important cases where the cutting device is stationary and the plastic material is manually moved relative to the same. In these cases both hands of the operator are usually needed for properly moving and guiding the plastic material to be cut, but only one hand was available for the purpose, the other hand being needed for closing the push-button switch and holding it closed. This difficulty has interfered with the proper cutting of the desired forms of plastic material, and has particularly made it difficult to cut out of relatively complicated forms.

Another difficulty has been encountered in the use of conventional cutting devices of the indicated type, with push-button switches manually held in closed position. It has happened that the operator, pursuant to placing the plastic material on the supporting plate for cutting this material by the heating wire, forgot the required closing of the circuit for heating the wire. He then contacted the plastic material with the wire, and thereby bent this wire, or in some case even tore it apart.

SUMMARY OF THE INVENTION

It is an object of the invention to provide a cutting device which avoids the aforementioned problems and difficulties.

A specific object is to provide a stationary cutting device which avoids the aforementioned problems and difficulties when used for cutting desired forms of plastic material.

According to the invention the objects are achieved by mounting the guide plate for supporting the material to be cut by the wire so as to make said plate movable between a first and a second position, and by so arranging the normally open switch for energizing the wire as to close this switch by said plate, in said second position of the latter. The new device advantageously includes a frame for holding the wire in vertical position between ends of the frame, and a generally flat support plate for the material to be cut, so attached to the frame that it can pivot between said first and second positions. The switch for energizing the wire has a push-button, which is normally upwardly biassed and thereby tends to tilt the support plate for the plastic material into slightly inclined position. In the operating condition of the device, the plastic material to be cut lies on the support plate. When the operator makes ready to move this material onto and across the cutting wire, he thereby tilts the support plate into its normal, horizontal operating position, initiating the heating of the wire. By this arrangement the invention enables the operator to move and guide the plastic material with both his hands. The cutting wire is heated during and only during the entire plastic-cutting operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
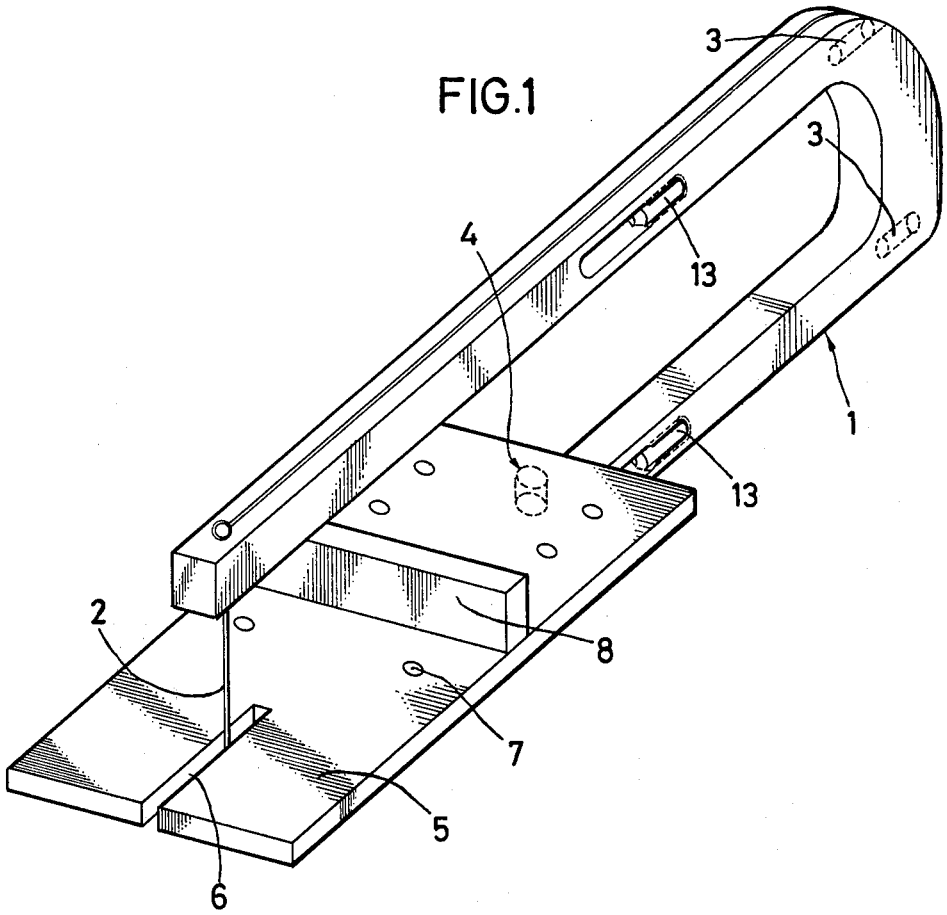
FIG. 1 is a perspective view of a cutting device according to the invention.

As shown in FIG. 1 the new cutting device comprises a support or 1 of generally C-shaped form with a pair of arms above one another which are interconnected at one end of their length. Cutting wire 2 extends vertically from the opposite end of one arm to the underlying end of the other arm. The circuit means for this wire (only partly shown in the drawing) include sockets 3 at the closed end of frame 1, for electrical connection to a source of current (now shown). Also included in the circuit is normally open push-button switch 4, mounted on the lower arm of frame 1.

Figure 2:
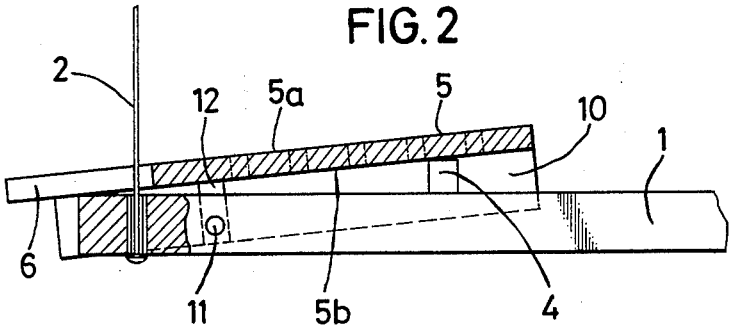
FIG. 2 is a view showing part of this device in central vertical section.

According to the invention a generally flat guide and support plate 5 for the plastic material to be cut is attached to frame 1 in a way illustrated best in FIG. 2. As shown here plate 5 has front end portions adjacent wire 2 which are pivotally connected to the lower arm of frame 1, and remotely therefrom the plate has a rear end portion which loosely lies on the push-button switch 4. It will be understood that in the operation of the device, the latter end of the plate is pressed downwardly, to place the top surface **5*a* of plate 5 into horizontal position, at substantially right angles to cutting wire 2. By so putting the support plate 5 into operative condition the operator, through the plate, depresses the push-button of switch 4, thereby closes the circuit for heating wire 2**, and places the device in readiness for operation.

In order to support plastic material in front of cutting wire 2 as well as behind it, support plate 5 extends forwardly of the wire, as best shown in FIG. 1. A slot 6 extends into the front part of the plate, allowing the wire 2 to extend through this slot.

Preferably the device has means for varying the width of strips which may be cut from plastic material. For this purpose the support plate 5 has holes 7 extending into and through the same from its upper surface **5*a*. As shown in FIG. 1, a guide strip 8 is provided on the top surface of plate 5. It will be understood that suitable pins (not shown) can be secured to the underside of this guide member, for insertion of such pins into suitably selected holes 7 and for thereby adjustably indexing guide strip 8 with different middle and back parts of support plate 5. In FIG. 2, support plate 5 is shown without guide member 8** thereon, this member being needed only optionally.

Figure 3:
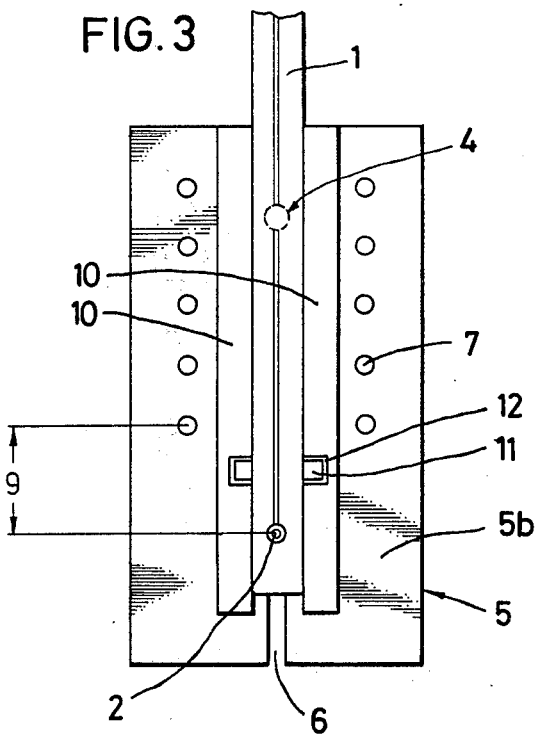
FIG. 3 is a bottom view of the part shown in FIG. 2.

For the pivotable attachment of support plate 5 to frame 1 and also to allow removal of the plate therefrom —for example for readjustment of guide member 8—, pivoting means are provided which preferably include a pair of ribs 10 secured to the underside of plate 5 (FIGS. 2 and 3), one of these ribs being parallel to the other to form therebetween a groove which suitably fits the side surfaces of the lower arm of frame 1. A pin 11 extends through this lower arm of frame 1, and has two ends which project from the side surfaces of the lower arm, for engagement with grooves 12 extending into ribs 10. This arrangement provides a simple pivoting arrangement for support plate 5. It allows this plate to be lifted from frame 1, if this be desired. When plate 5 is mounted, the illustrated arrangement prevents this plate from being undesirably shifted along frame 1, as a further precaution against bending or tearing of wire 2 by plastic material on the support plate 5.

Finally the construction illustrated in FIG. 1 includes apertures 13 shown as extending into and through the arms of frame 1, remotely from the frame portions adjacent plate 5, these apertures being of such form and design as to cooperate with fastening means for attaching the entire device to a suitable floor mounted stand or other general support (not shown), and/or, if desired, to provide for attachment of other structures, such as toy construction tools or parts, to frame 1.

In operation support plate 5 is pivotally attached, at 11/12 to the lower arm of frame 1. The rear end of plate 5 lies on the top portion of push-button switch 4, and is initially raised thereby as shown in FIG. 1. Front and middle portions of the plate engage the lower arm of frame 1, at the front end of this arm and by means of pivot pin 11 in slots 12. Thus the support plate is initially attached to the frame in generally flat but slightly inclined position. When plastic material to be cut has been placed on support plate 5, the rear end of this plate is tilted down by the weight of the plastic material, and/or by downward pressure exerted by the hands of the operator who grasps this material. The operator, thereby moves the plate from its initial tilted position into its operative horizontal position, as he overcomes the slight upward pressure of push-button switch 4. By the resulting closure of this switch wire 2 is energized and heated, so that the cutting of the plastic material can then be initiated at once. When the cutting has been completed the operator normally releases and/or removes the plastic material lying on the support plate 5, thereby allowing push-button 4 (or if desired an additional spring, not shown) to return plate 5 to its slightly tilted rest position, while opening the circuit of the cutting wire 2. This arrangement also makes sure that unnecessary consumption of current is avoided, as is desirable mainly when an electric battery is connected to the device, at 3, since otherwise the battery would be discharged all too rapidly by the strong heating current.

It will be understood that each of the elements described above, or two or more together, may also find a useful application in other types of cutting device differing from the types described above.

While the invention has been illustrated and described as embodied in a cutting device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

I claim:

1. A device for cutting plastic material, comprising a C-shaped support having two arms; an electric resistance wire extending from one of said arms to the other; a normally open switch mounted on said other arm at a distance from said wire and being adapted to energize said wire when actuated; a guide plate on said other arm supporting the plastic material to be cut, said plate being provided with a slot through which said wire extends; and means for rockably and removably mounting said plate on said other arm for pivotal movement between a first and a second position about an axis extending transversely of the elongation of said arms intermediate said wire and said switch so that, when said plate is rocked to said second position, said switch is actuated and said wire is energized to cut the plastic material.

2. A device as defined in claim 1 wherein said means for mounting said plate cooperates with said switch in holding said plate in said first position of the latter, slightly inclined from a substantial horizontal plane, subject to swinging of said plate about said mounting means, into said second position in which said plate is located in a substantially horizontal plane; said wire extending in substantially vertical direction.

3. A device as defined in claim 2, wherein said switch is a push-button switch arranged resiliently to push said plate toward said first position thereof, incident to the normal opening of the switch.

4. A device as defined in claim 2, including, on the underside of said plate, a pair of ribs parallel to one another and spaced from each other a distance corresponding substantially to the width of said support, said other arm being located between said ribs.

5. A device as defined in claim 4 wherein said mounting means includes a pivot member extending across said support, parallel to said plate.

6. A device as defined in claim 5, wherein said mounting means also includes a slot in each of said ribs, matching said pivot member; said slot opening downwardly to allow removal of said plate from said support.

7. A device as defined in claim 1 including guide means on said plate, for use in manual guidance of the plastic material over the plate, across said wire.

8. A device as defined in claim 7 wherein said guide means has a guide surface at right angles to said frame.

9. A device as defined in claim 7 including means for selectively mounting said guide means on said plate at a variety of distances from said wire.

* * * * *